United States Patent [19]

Arnason et al.

[11] 4,417,958

[45] Nov. 29, 1983

[54] PROCESS FOR EXTINGUISHING THE ANODE EFFECT IN THE ALUMINUM ELECTROLYSIS PROCESS

[75] Inventors: Tomas Arnason, Essen, Fed. Rep. of Germany; Alwis Franke, Gardabae, Iceland; Theodor Tschopp, St. Louis, Mo.

[73] Assignee: Swiss Aluminium Ltd., Chippis, Switzerland

[21] Appl. No.: 294,912

[22] Filed: Aug. 21, 1981

[30] Foreign Application Priority Data

Sep. 9, 1980 [CH] Switzerland ..... 6745/80

[51] Int. Cl.[3] ..... C25C 3/06; C25C 3/14; C25C 3/20

[52] U.S. Cl. ..... 204/67; 204/246

[58] Field of Search ..... 204/67, 245, 246

[56] References Cited

U.S. PATENT DOCUMENTS

| | | | |
|---|---|---|---|
| 2,713,024 | 7/1955 | Mantovanello | 204/245 |
| 3,135,672 | 6/1964 | Hirakawa et al. | 204/245 |
| 3,382,162 | 5/1968 | Trupiano et al. | 204/67 |
| 3,622,475 | 11/1971 | Shiver | 204/245 |
| 3,714,002 | 1/1973 | Kibby | 204/67 |
| 4,049,529 | 9/1977 | Golla | 204/246 |

FOREIGN PATENT DOCUMENTS

| | | | |
|---|---|---|---|
| 423885 | 9/1974 | U.S.S.R. | 204/245 |

*Primary Examiner*—Howard S. Williams

*Attorney, Agent, or Firm*—Bachman and LaPointe

[57] ABSTRACT

The anode effect which is necessary in the electrolytic cell can be extinguished after a short time if, immediately after it appears, fine granular salts are introduced together with an injection medium through a suitable channel into the electrolyte and under the anodes. These salts which are not harmful to the electrolytic process cause vigorous production of gases at the operating temperature of the cell. The channel for introducing the salts and the injection medium is usefully situated in the crust breaking chisel or a lance which can be lowered into the bath. The device comprises further a storage vessel for salts which has a closing facility which is activated via a closing piston, below that a combined measuring and injection chamber featuring an injection nozzle and a tube with by-pass connecting up to the injection chisel or lance.

13 Claims, 4 Drawing Figures

PROCESS FOR EXTINGUISHING THE ANODE EFFECT IN THE ALUMINUM ELECTROLYSIS PROCESS

The invention is related to a process for extinguishing the anode effect which occurs during the manufacture of aluminum by fused salt electrolysis, and also relates to a device for carrying out the said process.

The production of aluminum by the electrolysis of aluminum oxide involves dissolving the latter in a fluoride melt which, for the greater part, is made up of cryolite. The cathodically precipitated aluminum collects under the fluoride melt on the carbon floor of the cell, the surface of the liquid aluminum itself actually forming the cathode. Dipping into the melt from above are anodes which are attached to an overhead anode beam and, in conventional processes, are made of amorphous carbon. As a result of the decomposition of the aluminum oxide, oxygen is formed at the carbon anodes and combines with the carbon to form $CO_2$ and CO. The electrolytic process in general takes place at a temperature of about 940°–970° C. In the course of the reduction process the concentration of aluminum oxide in the electrolyte falls. At a lower concentration of 1–2 wt.% aluminum oxide in the electrolyte the so-called anode effect occurs which appears as an increase in voltage of e.g. 4–5 V rising to 30 V or more. Gas bubbles then form on the underside of the anodes and remain there reducing the wetting of the anode by the melt.

The anode effect is extinguished i.e. stopped in that normally two operational steps are taken in sequence, in modern cells fully automatically viz., (a) Breaking open of the crust and introducing alumina into the pot.

(b) Removal of the gas bubbles under the anode e.g. by temporarily introducing wooden rods into the pot, or injecting compressed air. The methods used to extinguish the anode effect have the disadvantage that they require relatively long for their completion. In U.S. Pat. No. 3,551,308 an attempt is made to reduce this time considerably, to about 20–30 seconds. This requires the electrolyte crust to be penetrated by at least one mechanically powered tool and to introduce a gaseous medium into the electrolyte via a pipeline in the breaker rod.

Known from the Russian Pat. No. 458 625 is to extinguish the anode effect in aluminum reduction cells by introducing powdered alkali or alkaline earth metal carbonates. As the decomposition products of these carbonates are constituents of the electrolyte no noticeable change in the chemical composition of the electrolyte takes place. The Russian Pat. No. 458 625 does not disclose how the powdered carbonate is to be introduced into the bath and under the anodes.

In practice the applicant found that the known method for extinguishing the anode effect requires 2–3 minutes with the dimensions of present day cells. The influence of an anode effect is however achieved in a much shorter time, for example in half a minute. An anode effect lasting longer than this represents, apart from an unnecessary loss of energy, excessive generation of heat in the cell.

SUMMARY OF THE INVENTION

The object of the invention is therefore to develop a process and device for carrying it out, which allow an optimal short interval of anode effect in aluminum reduction cells to be achieved and this at low conversion and operational costs.

This object is achieved by way of the invention in that, immediately after the anode effect appears, a fine grained salt which does not impair the electrolytic process, and causes vigorous production of gas at the operating temperature of the cell, is introduced via a carrier medium under pressure, through a suitable channel, into the molten electrolyte and under the anodes.

The first version of breaker chisel, also called injection chisel-features flow channels and at the bottom at least one exit opening, and is provided near the top with at least one feed pipe for the delivery of fine granular salts and a carrier medium injection feeding under elevated pressure. When the anode effect occurs, a small amount of the injection medium is blown through the chisel, preferably already while the device is not yet in action. The chisel is then lowered to the crust and pushed through it at least until the openings in the chisel are immersed in the liquid electrolyte. The injection medium flowing out of the openings prevents molten electrolyte from entering the feed channel /channels. In this working position a much larger amount of injection medium is passed through the chisel; at the same time the fine, granular salt is fed into the injection medium and thereby into the bath. After the anode effect has been stopped the feed of salt into the cell is also stopped and the amount of injection medium reduced. The injection chisel is then raised into the non-operative position; as it is raised a small amount of the injection medium is still allowed to pass through the chisel.

According to another version for use with cells having alumina feed systems which are always open (central and transverse feed, point feeding), the feeding of injection medium and salt takes place via a lance with at least one outlet which can be lowered into the bath. The dosage of injection medium and salt is as described in the previous paragraph.

Usefully, a gas is employed as the injection medium; for economic reasons in particular, compressed air is preferred. The amount of air injected per chisel or lance can, depending on the size of the outlet, amount to 5–50 l/min under reduced pressure conditions, and 100–2000 l/min when operating at full load.

The fine, granular or powdery salts comprise mainly at least one alkali or alkali earth metal carbonate. In the molten electrolyte the carbonates decompose in a very short time into metal oxides and carbon dioxide. Suitable carbonates which do not contaminate the electrolyte with harmful elements are, for example, soda ($Na_2CO_3$), limestone ($CaCO_3$) and magnesite ($MgCO_3$).

The feeding of the fine, granular salts to the molten electrolyte via the immersed chisel can take place continuously or in stages e.g. in charges of 150–250 g. If one charge is not sufficient to stop the anode effect, then further charges can be added.

The combination according to the invention of an injection medium fed into the electrolyte and with it a salt which results in a vigorous production of gas is so effective that the anode effect can be extinguished in a shorter time even than that aimed for. Therefore, with fully automatic, electronic data processor controlled cells in particular, a delay of e.g. 10–30 sec in the move to stop the anode effect is foreseen.

With respect to the device, the object of the invention is solved by means of a storage vessel with closeable cylinder which is used to store the salts, and below it a combined measuring and injection container with pneumatic nozzle, and also by means of a pneumatically activated injection chisel which is connected to the storage vessel via a connecting pipe and has an inner channel and outlet openings, or by means of a lance which can be pushed through an opening in the electrolyte crust.

BRIEF DESCRIPTION OF THE DRAWINGS

The invention will now be explained in greater detail with the help of the drawings viz.

DETAILED DESCRIPTION

Figure 1:
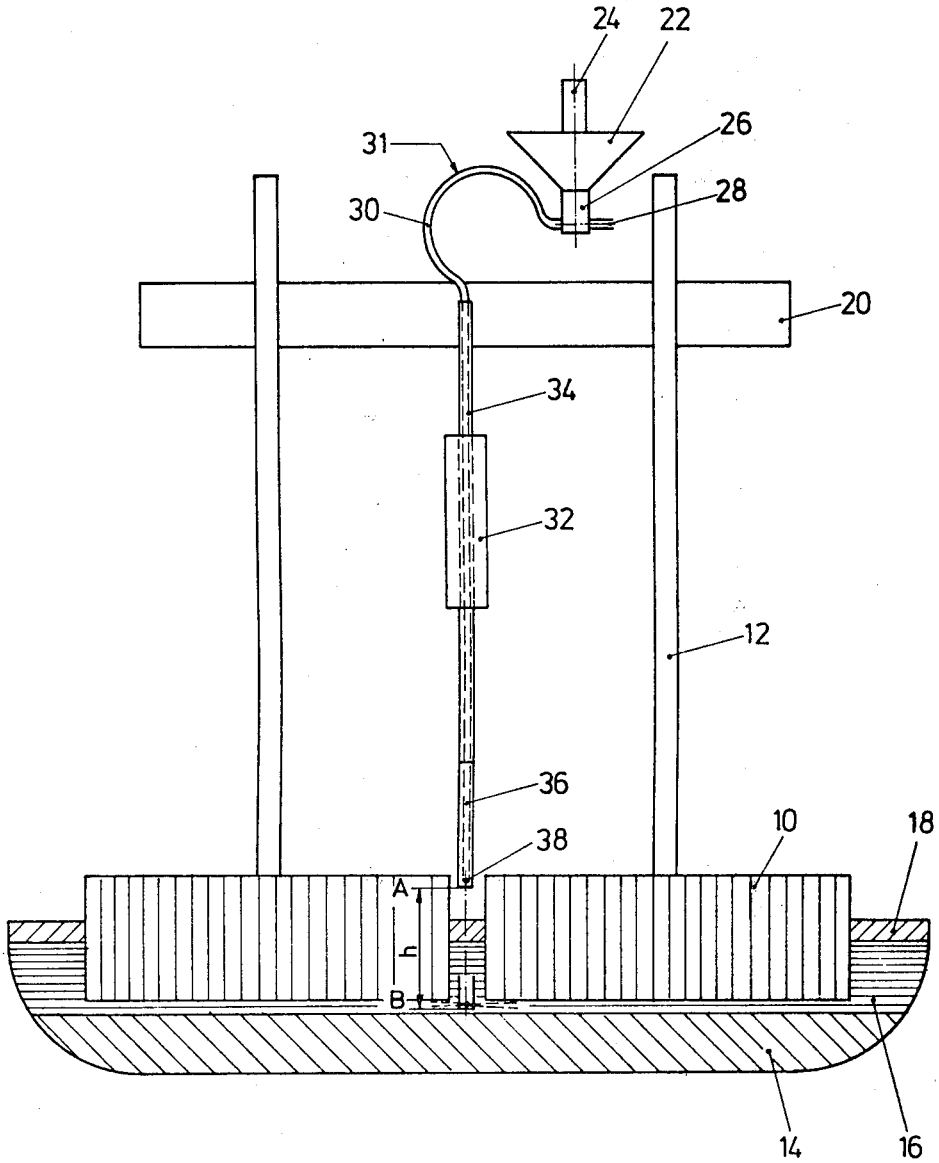
FIG. 1: An end view of part of a sectioned electrolytic cell with the device for stopping anode effects.

The carbon anodes 10 which are supported by anode rods 12 dip from above into the molten electrolyte 16 resting on the liquid aluminum. The uppermost layer of electrolyte 16 is in the form of a solid crust 18. The anode rods are secured to the anode beam by means of fixtures which are not shown here.

Also not shown is the cell superstructure on which a storage vessel 22 is mounted to hold the salts which are to be added to the cell when the anode effect occurs. A closing piston rod 24 regulates the flow of salts from this container 22.

The injection unit positioned below the vessel 22 comprises a measuring and injection cylinder 26 and a compressed air supply pipe 28 which is fitted with a nozzle.

The easy running salt is transported via a tube 30 to the central bore 34 of the piston rod of the injection chisel 36 where it can be blown out through opening 38 at its lower end. The chisel 36 is in the non-operative position with its lower end at a height A, and can be lowered a distance h to the working position at level B by means of a pneumatic cylinder 32. As the chisel 36 is lowered, it penetrates the crust 18 of solidified electrolyte.

As indicated by the broken lines, in this position B a salt which leads to a vigorous production of gas can be blown or injected under the anodes 10. The chisel 36 is raised again into the non-operative position by means of the pneumatic cylinder 32.

For simplicity the control facilities and means of activating the cylinder 24, the injection nozzle and the pneumatic cylinder 32 are not shown here. These are usefully controlled by an appropriately modified electronic data processor programme.

Figure 2:
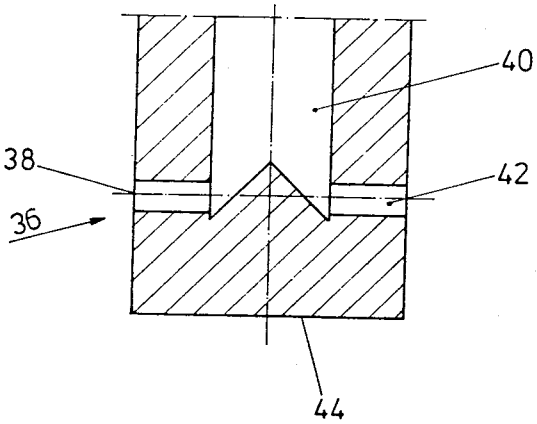
FIG. 2: A vertical section through the lower end of an injection chisel.

FIG. 2 shows the lower end of an injection chisel 36 with its inner bore 40 and outlet channels 38,42 for injection medium and salts. The outlet channels and openings can be of any desireable geometric form, however, round openings of 5–25 mm diameter are preferred. The bottom face 44 of the chisel is in the example shown in the form of a flat horizontal face; it can, however, be of any form normally employed for crust breaker chisels.

Figure 3:
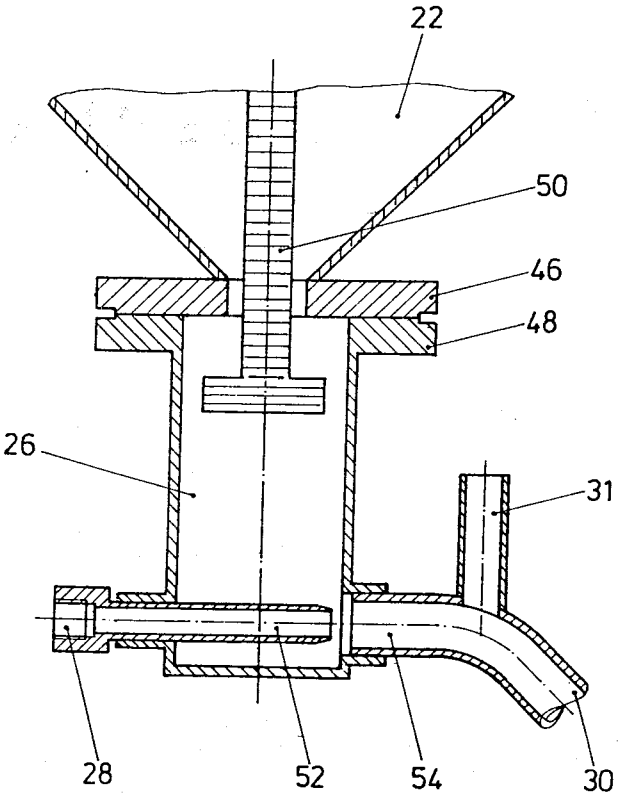
FIG. 3: A vertical section through a dosing device.

The dosing device shown in FIG. 3 comprises basically a storage vessel connected by flanges 46,48 and an air injection facility, to be described below. The outlet in the flange 46 for the salt in the storage container 22 can be closed by means of a closing means or facility 50.

An injection nozzle 52 mounted on the compressed air feed pipe 28 penetrates a sidewall of the measuring and injection container 26 very close to the bottom of that container. The wall of the container 26 diagonally opposite the nozzle 52 features an opening for the mixing space 54 which connects up via a tube 30 to the injection chisel 36.

Joining up to the connecting tube 30 is a by-pass 31. During the lowering and/or raising of the chisel 30 a small amount of injection medium, without salt, is blown through the outlets 38 and 42. At this stage the injection medium does not flow through the air injection facility but through the by-pass 31.

The ratio of salt fed to the electrolyte to injection medium is determined by the distance of the injector nozzle 52 from the entry port leading to the mixing space 54:

If the distance from the nozzle to the entry port is large, a relatively large amount of salt is required.

If the distance is small, only small amounts of salt are required.

Figure 4:
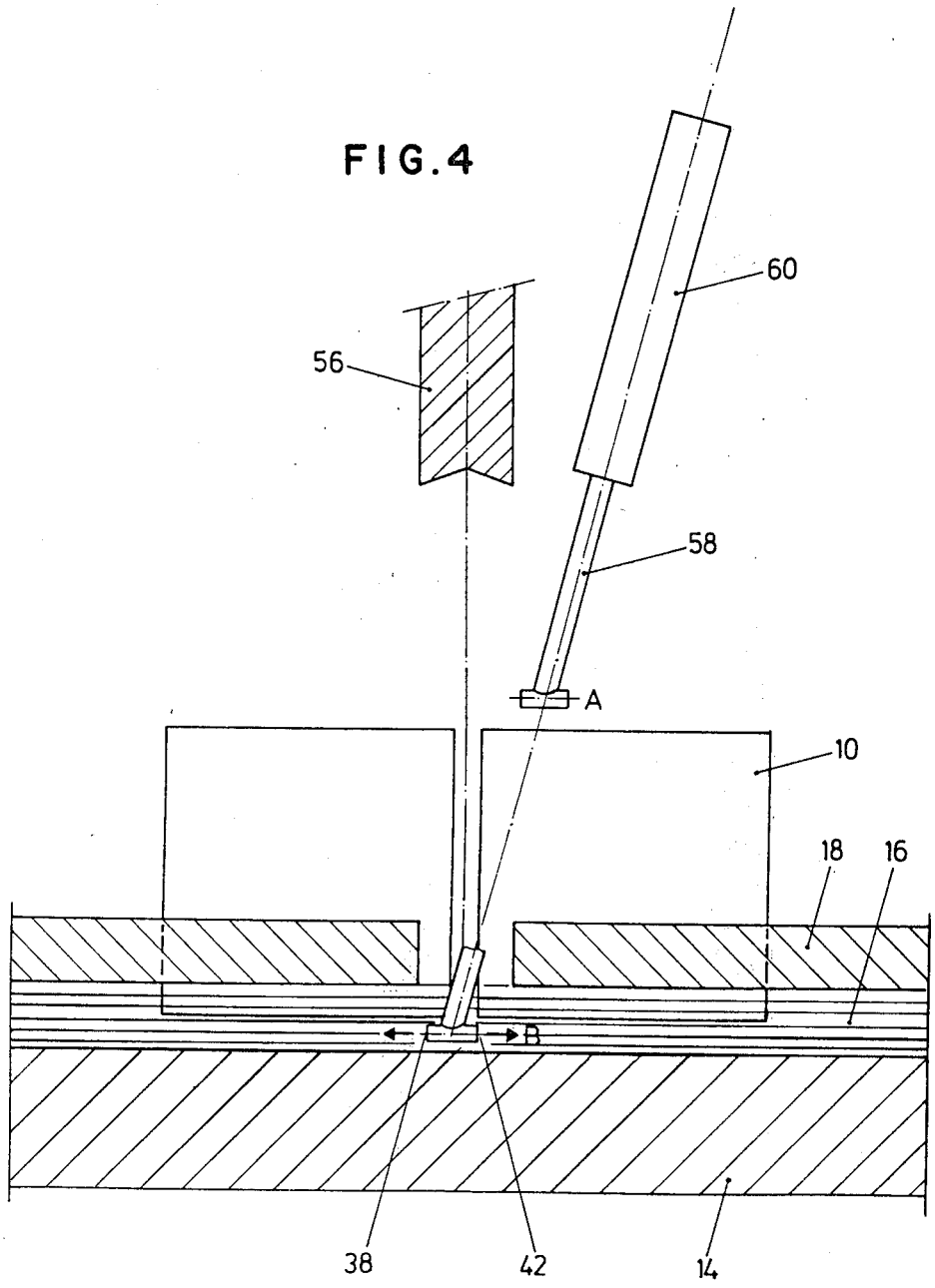
FIG. 4: A vertical section through the lower part of a device for extinguishing anode effects, with a lance.

The chisel 56 for point feeding an electrolytic cell with alumina (FIG. 4) keeps a hole open in the crust 18 at all times. The injection medium and salts are in that case not introduced through the chisel 56, but through a lance 58 which can be lowered by means of pressure cylinder 60 from the non-operative position A to the working position B. The lance is used to enter the molten electrolyte through the hole which is constantly kept open in the crust 18. The lance features two outlets 38,42 lying in an approx. horizontal position.

The injection medium emerging from the chisel or lance as it is being raised prevents the outlet channels 38,42 from becoming crusted over with solidified electrolyte 16. A more effective measure is the use of a flux wiper which is not shown in the drawing but is known to the expert in the field for freeing the chisel or lance of solidifying crust as it is raised.

The amount of injection medium being blown out of the chisel or lance as it is raised and lowered is relatively small as the fine powdered alumina lying on the crust 18 of solidified material, acting as cell insulation, would otherwise be unduly stirred up.

When the anode effect occurs in the aluminum reduction cell, it is extinguished by computer control or manually in the following way:

(a) The piston 24 raises the closure facility 50 and closes off the measuring and injector chamber 26 from the storage container 22.

(b) The valve for the by-pass 31 is opened to blow a small amount of injection medium directly through the chisel or lance.

(c) The pneumatic cylinder 32 lowers the chisel, or the pressure cylinder 60 the lance 50 out of which injection medium flows continuously; these penetrate the crust 18 and their end face reaches position B below the level of anodes in the vicinity of the interpolar gap between anode and cathode.

(d) After reaching position B, the injection facility is brought into action by opening the valve in the compressed air feed pipe 28 and a measured amount of salt introduced into the electrolyte below the anodes. Just before that stage, the valve to the by-pass is closed.

(e) If more than one measured amount of salt is required to halt the anode effect, the closure facility 50 is lowered one or more times. This causes the measuring and injection chamber 26 to be refilled with salt. If on the other hand salt is to be fed continously, the closure facility 50 is lowered only slightly and left in that position.

(f) After the anode effect has been stopped, the valve to the by-pass 31 is opened, that to the compressed air feed pipe 28 closed and the pneumatic cylinder 32 or pressure cylinder 60 activated such that the injection chisel 36 or lance 58 is raised to the non-operative position A.

(g) The piston 24 lowers the closure facility 50, whereupon the measuring and injection chamber 26 is again filled completely with salt.

What is claimed is:

1. Process for extinguishing the anode effect which occurs during the production of aluminum by fused salt electrolysis, which comprises introducing into the molten electrolyte and under the anodes immediately after the anode effect appears, fine grained salts which are not harmful to the electrolytic process and which decompose to cause a vigorous production of gas at the operating temperature, wherein said salts are introduced into the molten electrolyte via an injection or carrier medium under pressure, thereby extinguishing the anode effect in a short period of time.

2. Process according to claim 1 wherein the salts are introduced via a carrier medium under pressure through a channel.

3. Process according to claim 1 wherein the injection medium is passed into the electrolyte through the crust, together with the salts, through a channel in a breaker chisel or lance.

4. Process according to claim 3 wherein the chisel or lance is lowered below the crust, during which time a small amount of injection medium flows out of the chisel or lance, then the amount of injection medium is increased and fine grained salt injected with it, and finally the chisel or lance is raised with a small amount of injection medium flowing therefrom.

5. Process according to claim 1 wherein a gaseous injection medium is employed.

6. Process according to claim 5 wherein the injection medium is compressed air.

7. Process according to claim 1 wherein the fine grained salt employed includes at least one of the alkali or alkali earth metal carbonates.

8. Process according to claim 7 wherein said carbonates are in powder form.

9. Process according to claim 7 wherein said carbonate is a material selected from the group consisting of sodium carbonate, calcium carbonate, magnesium carbonate, and mixtures thereof.

10. Process according to claim 1 wherein fine grained salt is introduced in stages.

11. Process according to claim 10 wherein said salt is introduced in charges of 150 to 250 grams.

12. Process according to claim 1 wherein the feed of fine grained salt via an injection medium is started 10–30 seconds after the anode effect starts.

13. Process according to claim 1 including: providing a storage means for said salts and means communicating therewith for introducing said salts together with said injection medium into the molten electrolyte; providing a dosing device communicating with said storage means; and introducing into the molten electrolyte measured amounts of said salts together with said injection medium by means of said dosing device.

* * * * *